US007185375B1

(12) United States Patent
Movsas

(10) Patent No.: US 7,185,375 B1
(45) Date of Patent: Mar. 6, 2007

(54) COLLAPSIBLE PORTABLE TOILET APPARATUS WITH PRIVACY SCREEN

(76) Inventor: Tammy Movsas, 2106 Acqueduct La., Cherry Hill, NJ (US) 08002

( * ) Notice: Subject to any disclaimer, the term of this patent is extended or adjusted under 35 U.S.C. 154(b) by 314 days.

(21) Appl. No.: 10/710,634

(22) Filed: Jul. 26, 2004

Related U.S. Application Data

(60) Provisional application No. 60/521,953, filed on Jul. 26, 2004, provisional application No. 60/556,308, filed on Mar. 25, 2004.

(51) Int. Cl.
*A47K 11/06* (2006.01)

(52) U.S. Cl. ..... 4/484; 4/480

(58) Field of Classification Search ..... 4/480, 4/484, 526–528, 531, 534; 297/184; 135/90
See application file for complete search history.

(56) References Cited

U.S. PATENT DOCUMENTS 3,203,007 A * 8/1965 Olson ..... 4/484
5,564,136 A * 10/1996 Cox ..... 4/480
6,296,002 B1 * 10/2001 Tashchyan ..... 135/96
6,934,980 B2 * 8/2005 Harney ..... 5/81.1 R

* cited by examiner

*Primary Examiner*—Justine Yu
(74) *Attorney, Agent, or Firm*—Michael P. Eddy

(57) ABSTRACT

A portable toilet apparatus in a form of collapsible, folding chair including a planar square platform with an opening formed in the central portion thereof a removable receptacle with an upper and lower ring which is accommodated in the opening, two or more elongating telescoping poles attached to the back of the chair, each telescoping pole has a locking clip to secure the pole in an extended orientation, a collapsible planar frame attached to the top of the telescoping poles, and a foldable canopy supported by the frame. The canopy is unfolded into a top planar surface and a back planar surface when the chair is opened. A removable folding privacy screen attached to the canopy. When the screen is unfolded the screen forms a generally rectangular planar surface having a plurality of outer planar surfaces opposite a plurality of inner planar surfaces covering an area including the front and two sides of the chair.

9 Claims, 13 Drawing Sheets

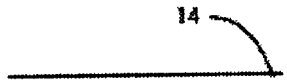
FIG. 9A
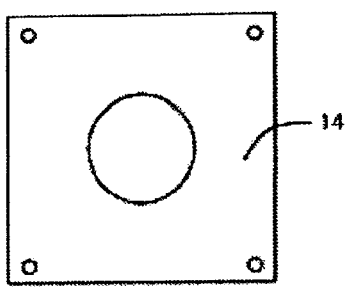
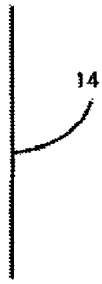

COLLAPSIBLE PORTABLE TOILET APPARATUS WITH PRIVACY SCREEN

This application claims the benefit of U.S. Provisional Application No. 60/556,308, filed on Mar. 25, 2004, and U.S. Provisional Application No. 60/521,953, filed on Jul. 26, 2004.

BACKGROUND OF INVENTION

The present invention relates generally to the field of portable toilets, and more specifically portable, collapsible toilets with privacy screens for use in areas where conventional restrooms are not available.

SUMMARY OF INVENTION

The present invention combines a collapsible, folding chair with the features of a toilet seat, a collapsible canopy to cover the top and back, and a collapsible portable privacy screen.

One embodiment of the present invention includes a portable toilet apparatus comprising a collapsible, folding chair including a planar square platform with an opening formed in the central portion thereof a removable receptacle with an upper and lower ring which is accommodated in said opening, two or more elongating telescoping poles attached to the back of said chair wherein each telescoping pole can be extended or retracted and wherein each telescoping pole has a locking clip to secure said pole in an extended orientation, a collapsible planar frame attached to the top of said telescoping poles, a foldable canopy supported by said frame, wherein said canopy is unfolded into a top planar surface and a back planar surface when said chair is opened, a removable folding privacy screen attached to said canopy wherein when said screen is unfolded, said screen forms a generally rectangular planar surface having a plurality of outer planar surfaces opposite a plurality of inner planar surfaces covering an area including the front and two sides of said chair.

Another embodiment of the present invention includes a privacy screen primarily comprised of a canvas material.

Another embodiment of the present invention includes a canopy primarily comprised of a canvas material.

Another embodiment of the present invention includes a canopy primarily comprised of a ripstock material.

Another embodiment of the present invention includes a privacy screen primarily comprised of a ripstock material.

Another embodiment of the present invention includes a toilet paper roll holder.

Another embodiment of the present invention includes a cylindrical carrying bag.

Another embodiment of the present invention includes a removable privacy screen.

Having thus described embodiments of the present invention, it is the principal object of the present invention to provide an improved collapsible portable toilet apparatus that can be easily transported from one place to another.

BRIEF DESCRIPTION OF DRAWINGS

The above and other objects, advantages and features of the present invention will be more readily apparent from the following description, when read in conjunction with the accompanying drawings wherein:

FIG. 9A is a perspective side view of the square platform 14 of an embodiment of the present invention;

DETAILED DESCRIPTION

Figure 1:
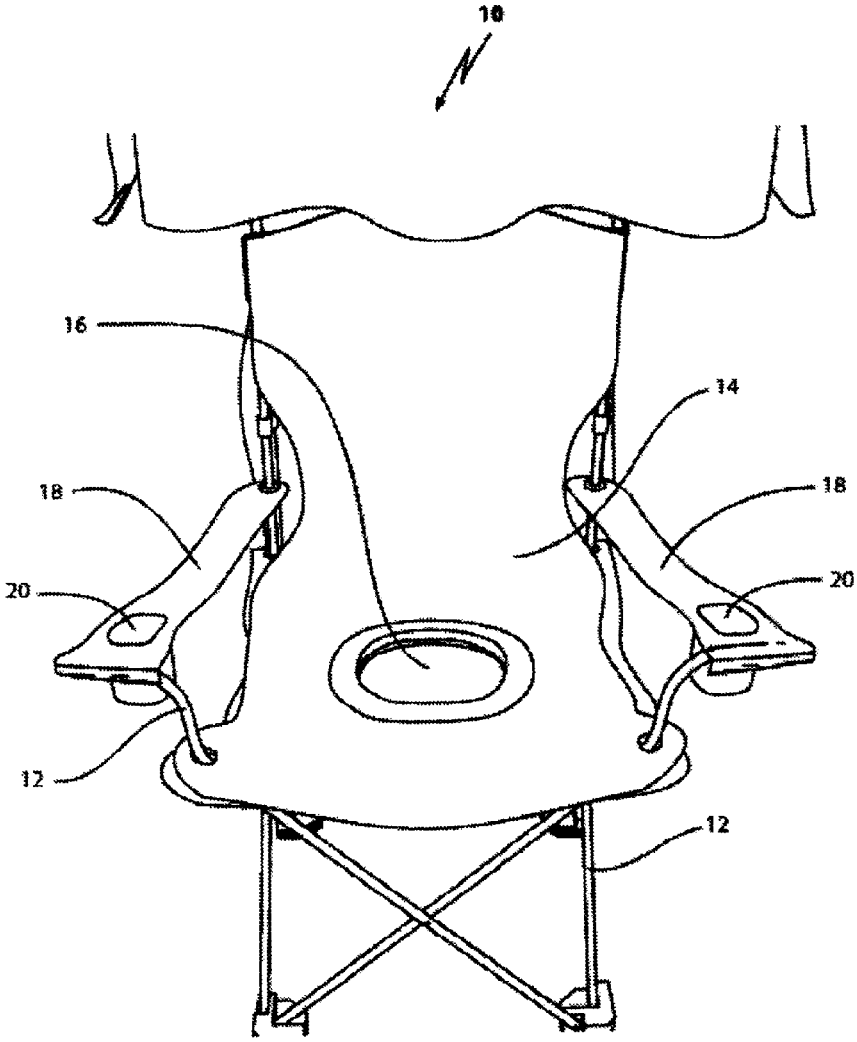
FIG. 1 is a front perspective view of the lower portion of an embodiment of the present invention without the privacy screen.

Turning now descriptively to the drawings, in which similar reference characters denote similar elements throughout several views, FIGS. 1 through 13 illustrate an embodiment of the collapsible portable toilet apparatus designated generally by the numeral 10. In this apparatus 10, a collapsible folding chair is used in conjunction with a waste receptacle, support frame with canopy, and a privacy screen. The collapsible folding chair used in the embodiment can be any commercially available portable collapsible folding chair adapted to accommodate the lower planar surface which is also used as the seat and which holds the waste receptacle in place. This embodiment is adapted so that the support frame and canopy together collapse completely into the chair.

FIG. 1. illustrates the lower front portion of an embodiment of apparatus 10 which is made up of the lower portion of a folding chair comprised of a support structure 12 with legs and arm rests and a planar square platform 14 with a waste receptacle 16 in an opening formed in the central portion thereof. Armrests 18 are able to be folded away with the remainder of the chair when collapsed. Openings 20, found on each armrest in the present embodiment, may be used to hold one or more toilet paper rolls. Privacy screen 22 is positioned to the top and away from the user to enable the user to sit in or leave the chair.

Waste receptacle 16 may or may not be removable, and can be covered when not in use. In one embodiment, there is a netting or meshwork under the aperture in the lower planar surface in the seat of the chair. Further, in this embodiment, a disposable bag is placed in the netting and then discarded after use. The netting in this embodiment is not removable, although it may be removable in other embodiments. A material of any shape, such as a circular, rectangular, square shape, can be placed over the receptacle 16 and held down with a material such as Velcro® to convert the apparatus 10 into a beach chair. In this embodiment, the privacy screen 22 is removed. Accordingly, embodiments of apparatus 10 can be configured both as a beach chair with privacy screen 22 removed and receptacle 16 covered, and as a portable toilet, with the privacy screen 22 positioned to shield user's from view and with receptacle 16 uncovered for use.

Instead of having a folding frame with three separate sides, an embodiment of the present invention has one side, attached to the rear of the collapsible chair portion of the embodiment, made up of the two telescoping poles, which may telescope or extend up from the chairs' back legs or be separately attached to the chair's legs and independently extend up from the chair, and a canopy 30 that supports the privacy screen 22 section which covers the other exposed sides of the present embodiment (the front and side areas of the apparatus 10.) In this embodiment, the privacy screen is not removable, but other embodiments include a removable privacy screen.

In this embodiment, when apparatus 10 is un-deployed or collapsed, privacy screen 22, which is attached to canopy 30, folds with canopy 30. No extra steps are needed to take down and put up the privacy screen. Another embodiment has a removable privacy screen 22. Privacy for the user is thereby afforded on all four sides in addition to the top of the embodiment giving the user complete privacy. Privacy screen 22, which can also be a curtain, is opened and closed by hook and loop attachments such as VELCRO® attachments which is sewn into the material of the privacy screen 22. Privacy screen 22 can be made of ripstock vinyl, canvas or any similar material. In one or more other embodiments, a material that is lighter than canvas may be used.

Other embodiments of apparatus 10 include a conversion kit whereby a user uses a conversion kit embodiment to convert an existing chair or portable toilet into an embodiment including a collapsible canopy, a privacy screen 22 and retractable arms that can be mounted onto the existing chair or toilet by a clamping device wherein the arms are attached to the back of the chair or toilet, extended upward and locked into place.

Figure 2:
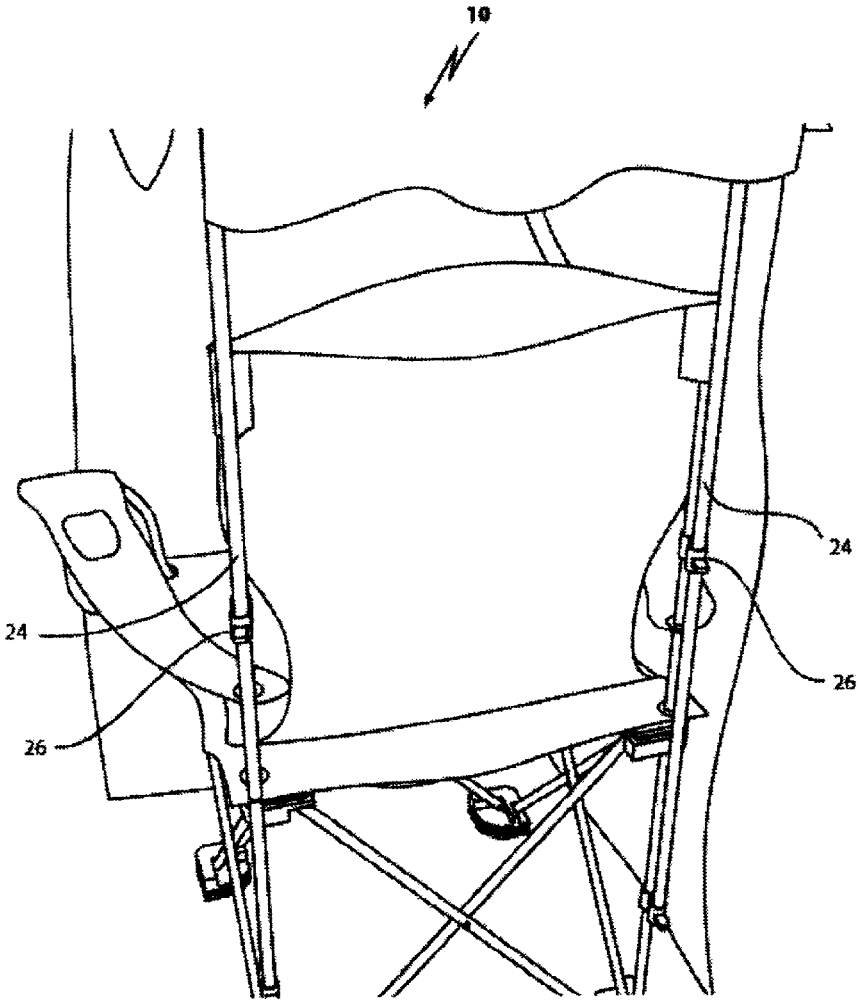
FIG. 2 is a rear perspective view of the lower portion of an embodiment of the present invention with the privacy screen positioned to the side.

FIG. 2 is a rear perspective view of the lower portion of an embodiment of the present invention with the privacy screen 22 positioned to the side. In this embodiment, the two support poles of support frame 24 are shown extending up from the back of the chair. Each of these two elongating telescoping poles attached to the back of the chair can be extended or retracted. When they are in an extended orientation, these poles can be secured into place with locking clips 26.

The poles forming the support frame 24 may be constructed of multiple poles with one pole fitting into the pole beneath it, or one pole may be attached to another pole externally. In this embodiment, the poles are extended in the open position and then locked into place. The poles extend to a top planar array of tubular supports 28 (not shown) forming a top frame which in turn support canopy 30 (not shown.) Privacy screen 22 is shown positioned to the side and away from the user to enable the user to sit in or leave the chair.

Figure 3:
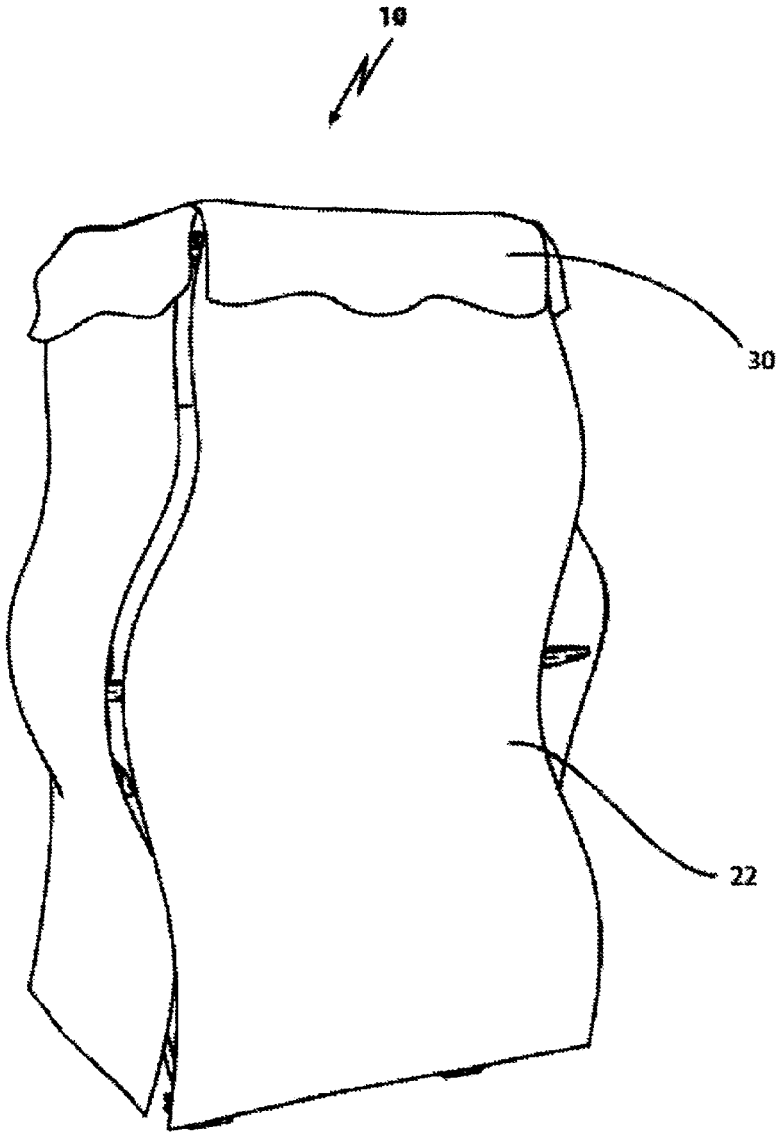
FIG. 3 is a front perspective view of an embodiment of the present invention with the privacy screen and canopy installed.

FIG. 3 is a front perspective view of an embodiment of the present invention with the privacy screen 22 and canopy 30 installed so that privacy is fully provided to the user of the embodiment.

Figure 4:
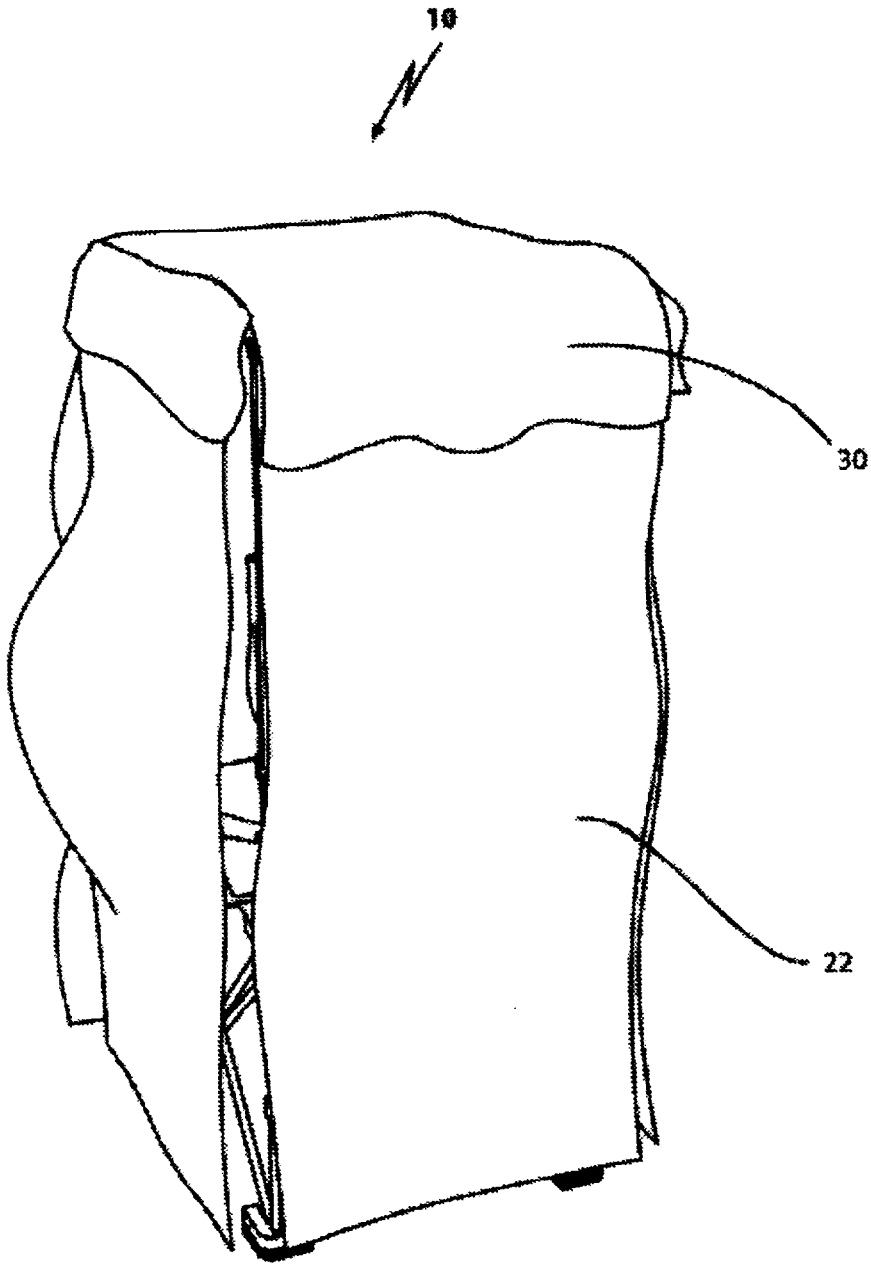
FIG. 4 is a rear top perspective view of an embodiment of the present invention with the privacy screen and canopy installed.

FIG. 4 is a rear top perspective view of an embodiment of the present invention with privacy screen 22 and canopy 30 deployed.

Figure 5:
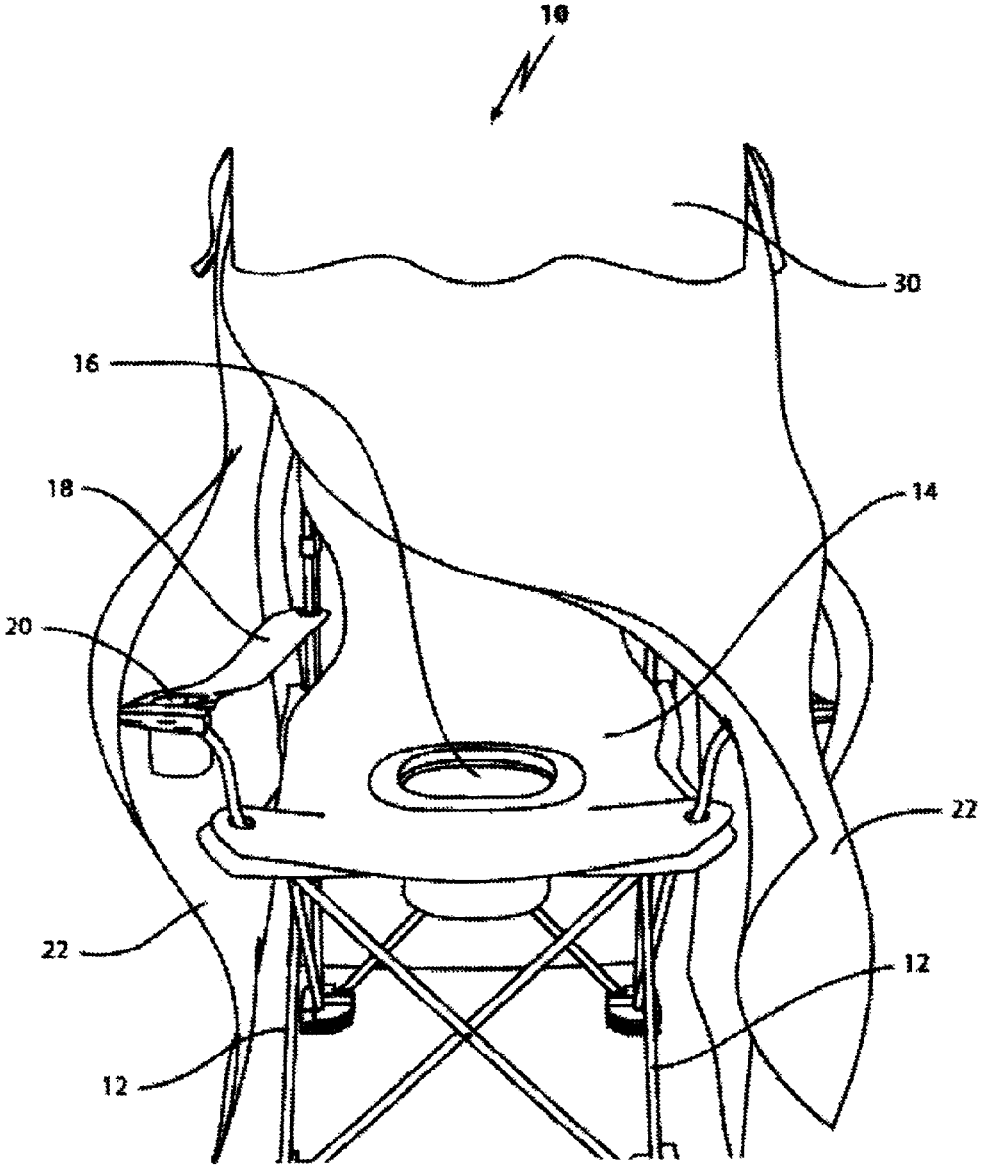
FIG. 5 is a front perspective view of an embodiment of the present invention with the privacy screen and canopy installed.

FIG. 5 is a front perspective view of an embodiment of the present invention with privacy screen 22 attached to canopy 30 wherein a portion of privacy screen 22 is positioned to the side in order to illustrate the interior compartment during the deployed state of the present embodiment.

Figure 6:
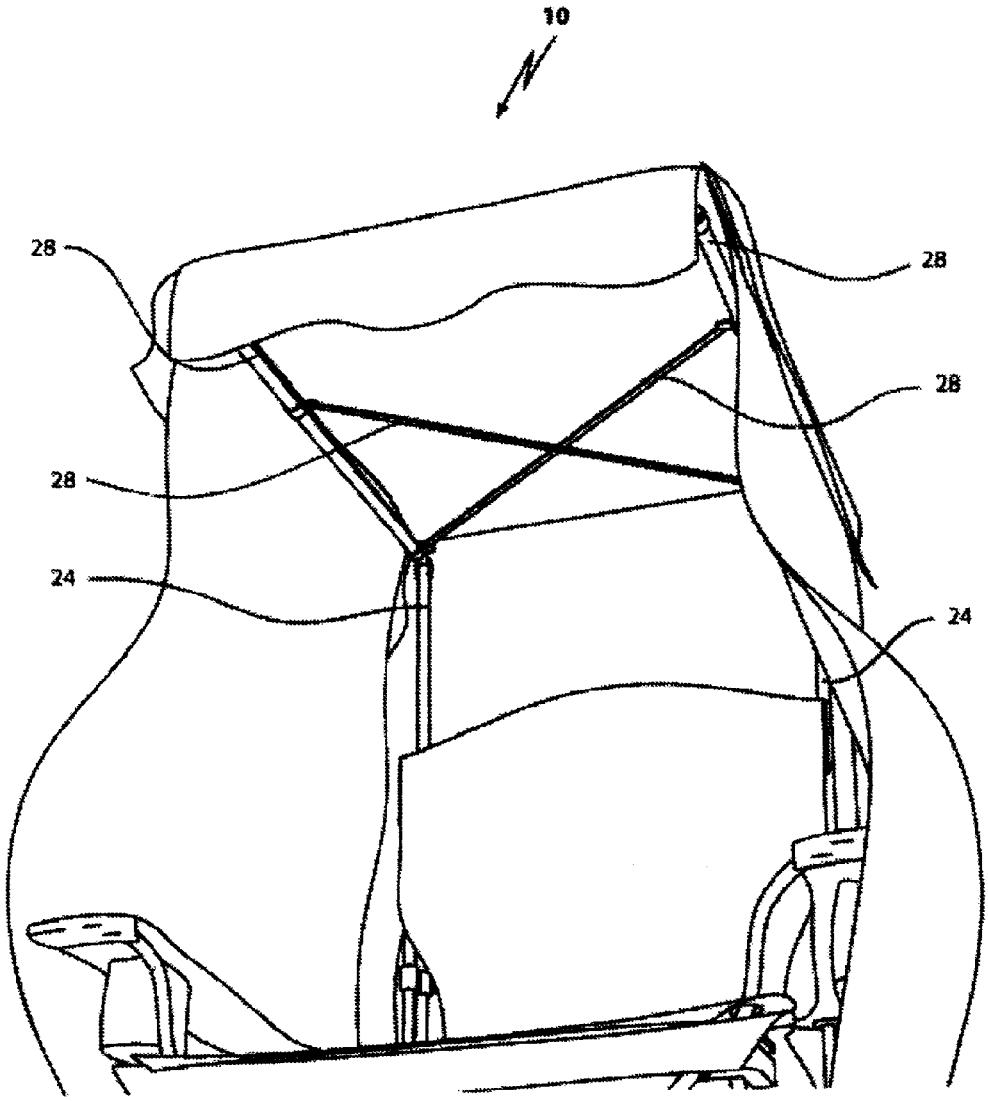
FIG. 6 is a partial front perspective view of an embodiment of the present invention.

FIG. 6 is a partial front perspective view of an embodiment of the present invention illustrating the poles forming a support frame. This planar array of tubular supports 28 forms a top frame which in turn supports canopy 30. Supports 28 are connected to the top of support frame 24. Canopy 30 unfolds when the chair is in the open and deployed orientation. The privacy curtains are then attached to canopy 30.

Figure 7:
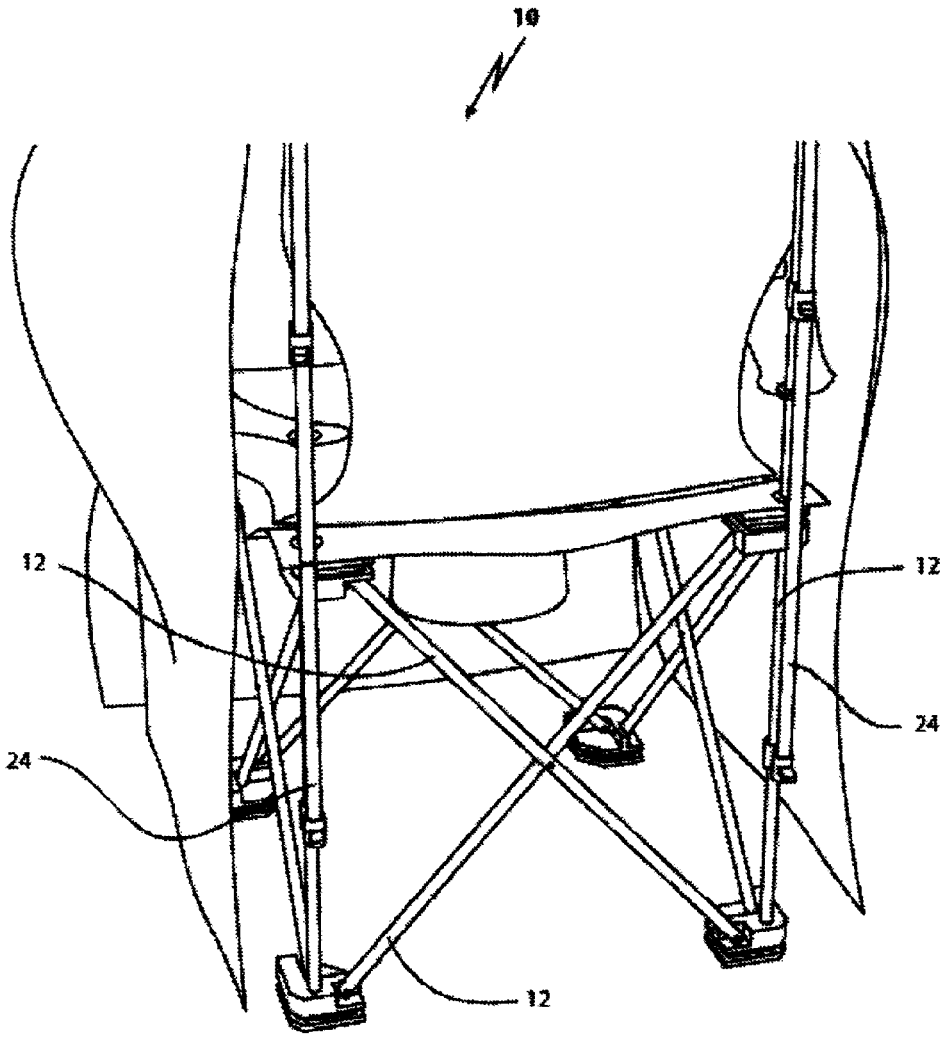
FIG. 7 is a partial lower rear perspective view of an embodiment of the present invention.

FIG. 7 is a partial lower rear perspective view of an embodiment of the present invention illustrating the relationship of the support frame 24 to the support structure 12 of the chair.

Figure 8A:
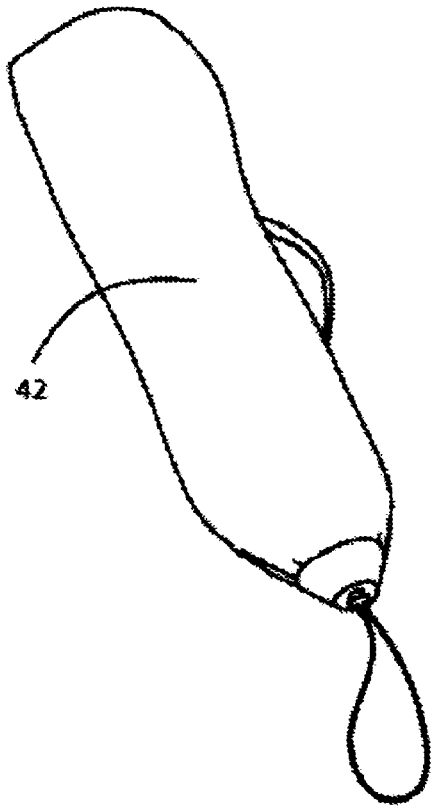
FIG. 8A is a perspective view of one embodiment of the present invention.
Figure 8B:
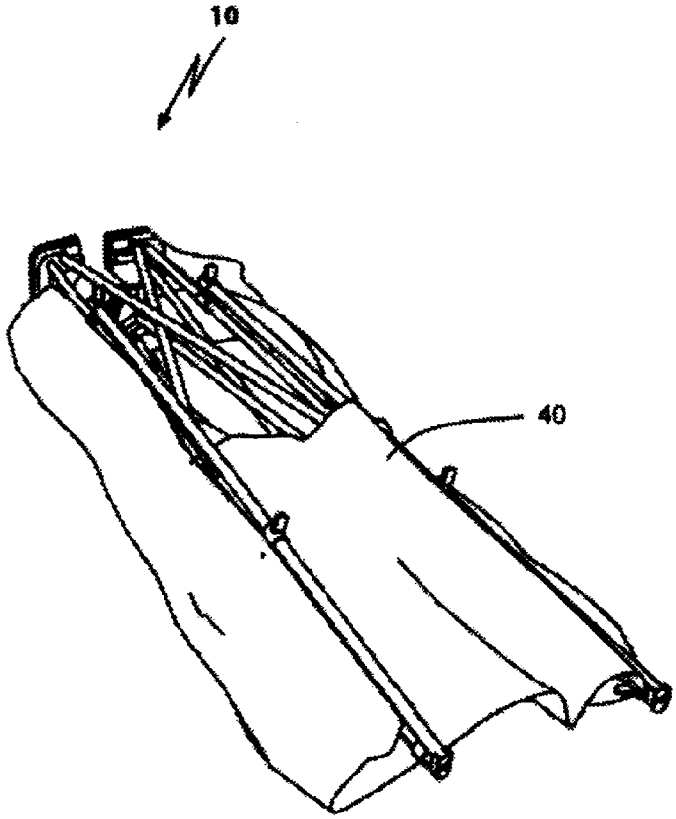
FIG. 8B is a perspective view of one embodiment in a folded state of the present invention.

FIG. 8A is a perspective view of one embodiments of the present invention whereby embodiment 42 is in the undeployed state and encased in a travel bag. FIG. 8B illustrates embodiment 40 of apparatus 10 in a folded state. In these embodiments, the support frame 24, the support structure 12, and the canopy 30 completely collapse down so that apparatus 10 is easy to transport and store.

Figure 9B:
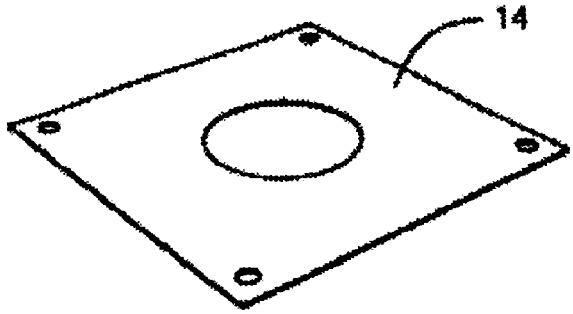
FIG. 9B is a perspective view of the platform 14 of the toilet seat in an embodiment of the present invention.
Figure 9C:
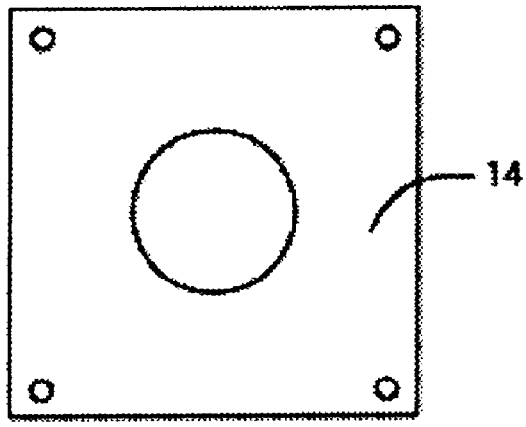
FIG. 9C is a perspective side view of the square platform 14 of an embodiment of the present invention.
Figure 9D:
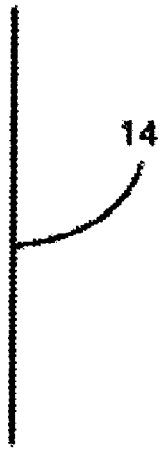
FIG. 9D is another perspective side view of the square platform 14 of an embodiment of the present invention.

FIGS. 9A and 9D are perspective side views of the square platform 14 with an aperture of an embodiment of the present invention. An aperture is provided so that waste receptacle 16 can be accommodated in the lower planar structure of the chair. One embodiment of apparatus 10 includes an upper and a lower ring affixed to platform 14 which acts as a seat. These upper and lower rings can be sections or pieces of circular material that have been permanently sewn onto the fabric to reinforce the netting that holds the disposable bag which is hung beneath waste receptacle 16.

Other embodiments may include circular rings of various materials such as cloth, vinyl, and plastic, both with and without netting attached. A disposable bag can be placed through the ring to hold the waste. Another additional ring constructed of plastic or the like may be placed over the cloth ring described to act as a toilet seat.

FIG. 9B is a perspective view of the platform 14 of the toilet seat in an embodiment of the present invention.

FIG. 9C is a top plan view of the platform 14. Platform 14 can be constructed of an upper ring 44 and lower ring 46 (not shown) to facilitate the removal and installation of waste receptacle 16.

While the present invention has been illustrated and described by means of specific embodiments and alternatives, it is to be understood that numerous changes and modifications can be made without departing from the spirit and scope of the invention. Therefore, it should be understood that the invention is not to be limited in any way except in accordance with the appended claims and their equivalents.

The invention claimed is:

1. A portable toilet apparatus comprising:

a collapsible, folding chair including a planar square platform with an opening formed in the central portion thereof;

a removable receptacle with an upper and lower ring which is accommodated in said opening;

two or more elongating telescoping poles attached to the back of said chair wherein each telescoping pole can be extended or retracted and wherein each telescoping pole has a locking clip to secure said pole in an extended orientation;

a collapsible planar frame attached to the top of said telescoping poles;

a foldable canopy supported by said frame, wherein said canopy is unfolded into a top planar surface and a back planar surface when said chair is opened;

a removable folding privacy screen attached to said canopy wherein when said screen is unfolded, said screen forms a generally rectangular planar surface having a plurality of outer planar surfaces opposite a plurality of inner planar surfaces covering an area including the front and two sides of said chair.

2. The portable toilet apparatus as recited in claim 1, wherein said receptacle is a removable bag.

3. The portable toilet apparatus as recited in claim 1, wherein said canopy is primarily comprised of canvas.

4. The portable toilet apparatus as recited in claim 1, wherein said privacy screen is primarily comprised of canvas.

5. The portable toilet apparatus as recited in claim 1, wherein said privacy screen is removable.

6. The portable toilet apparatus as recited in claim 1, wherein said canopy is primarily comprised of ripstock vinyl.

7. The portable toilet apparatus as recited in claim 1, wherein said privacy screen is primarily comprised of ripstock vinyl.

8. The portable toilet apparatus as recited in claim 1, further comprising a toilet paper roll holder.

9. The portable toilet apparatus as recited in claim 1, further comprising a cylindrical carrying bag.

* * * * *